United States Patent [19]

Chapman et al.

[11] Patent Number: 4,792,285

[45] Date of Patent: Dec. 20, 1988

[54] INJECTION PUMP

[76] Inventors: Allen F. Chapman, Great Hill Pond Rd., Portland, Conn. 06480; Peter Honnef, 32 Harding St., Wethersfield, Conn. 06109

[21] Appl. No.: 437,112

[22] Filed: Oct. 27, 1982

[51] Int. Cl.[4] ..... F02M 39/00

[52] U.S. Cl. ..... 417/206; 123/495; 123/450; 417/204

[58] Field of Search ..... 123/450, 500, 501, 502, 123/495; 123/495; 417/204, 206, 205, 262, 269

[56] References Cited

U.S. PATENT DOCUMENTS

| | | | |
|---|---|---|---|
| 1,971,601 | 8/1954 | Dilg | 417/206 |
| 2,053,057 | 9/1936 | Woolson | 123/500 |
| 2,146,184 | 2/1939 | High | 417/206 |
| 2,280,875 | 4/1942 | Wahlmark | 417/206 |
| 2,395,964 | 3/1946 | Fodor | 123/501 |
| 2,591,533 | 4/1952 | Fritz | 417/206 |
| 2,608,158 | 8/1952 | Beaman | 417/206 |
| 2,609,047 | 7/1952 | Beaman | 417/206 |
| 2,847,938 | 8/1958 | Gondek | 417/205 |
| 2,995,685 | 11/1950 | Beaman | 417/206 |
| 3,016,838 | 1/1962 | Bessiere | 417/206 |
| 3,331,327 | 7/1967 | Roosa | 417/206 |
| 3,394,688 | 7/1968 | Roosa | 47/206 |
| 4,105,369 | 8/1978 | McClocklin | 417/206 |

*Primary Examiner*—Carl Stuart Miller

[57] ABSTRACT

A fuel injection pump includes a pumping section that is segregated from the drive mechanism to permit independent lubrication of the latter, thereby avoiding any need for reliance upon the fuel supplied for that purpose. Generally, the unit will have two pumping stages, one utilizing a rotating vane arrangement and the second comprising reciprocating pistons, and it may include novel means for adjusting timing and speed, which means may automatically be controlled in response to fuel pressure.

16 Claims, 4 Drawing Sheets

INJECTION PUMP

BACKGROUND OF THE INVENTION

Fuel injection pumps are commonly designed to have two stages, a preliminary stage for fuel intake and pressurization, and a secondary stage from which the fuel is injected to the engine. The injection stage of such a pump may comprise a plurality of reciprocating pistons which intermittently discharge the fuel from associated cylinders, in properly timed sequence.

A mechanism of this sort is described, for example, in Dilig U.S. Pat. No. 1,971,601, wherein vane and piston pumps are employed to provide the two-stage effect. Beaman et al U.S. Pat. Nos. 2,495,685, 2,604,047, and 2,608,158 are similar, and Fritz U.S. Pat. No. 2,591,533 utilizes gear and piston pumps to achieve such an effect in an oil burner unit. U.S. Pat. Nos. 3,331,327, 3,363,569, and 3,394,688, to Roosa, employ a vane pump in combination with a high pressure, reciprocating piston pump, and a centrifugal governor and timing cam arrangement is disclosed. Similar units are also described in McClocklin U.S. Pat. Nos. 4,105,369, and in Bessiere 3,016,838.

Injection pumps of the type hereinabove referred to utilize the fuel itself as the means by which the moving parts ar lubricated. While this is, of course, entirely feasible when a petroleum-based fuel is employed, attempt to use other fuels can introduce serious, and indeed insurmountable, problem in such a pump Thus, an inadequately lubricated pump will ultimately "freeze" and become inoperative.

Accordingly, it is a primary object of the present invention to provide a novel pump assembly in which the pumping section is segregated from the drive mechanism, thereby permitting independent lubrication of the latter and use of the pump for a relatively non-lubricating fuel.

It is a more specific object of the invention to provide a two-stage injection pump that is adapted for use to pump aqueous fuels for hydrogen powered systems.

It is another object of the invention to provide a pump assembly having the foregoing features and advantages, which assembly is relatively uncomplicated and inexpensive to manufacture, and is yet highly efficient and dependable in operation.

A further object of the invention is to provide such an assembly having novel means for readily permitting adjustment of its timing to the ignition cycle of the engine with which it is employed.

A still further object of the invention is to provide such an assembly having novel throttling means for permitting automatic adjustment of the volume of fuel injected, in response to engine speed.

SUMMARY OF THE INVENTION

It has now been found that certain of the foregoing and related objects of the invention are readily attained in a two-stage fuel injection pump assembly, including a pump block mounted within the body of the assembly and defining a drive mechanism section to one side thereof. The block has a pump chamber disposed to its opposite side, and a plurality of piston cylinders extending therethrough and disposed thereabout on axes that are generally parallel to a central axis of the block. A corresponding plurality of injection pistons are slidably mounted for reciprocal movement within the cylinders of the block, and sealing means is provided for segregating the pump chamber from the drive mechanism section, against liquid flow therebetween. Seated within the pump chamber of the block is a rotary pump member, which cooperates therewith to provide a pumping section. Driven means within the drive mechanism section is operatively connected for reciprocation of the pistons and for rotation of the pump member, and distributor means is disposed to the opposite side of the pump block. The distributor means and the pump block cooperate to distribute fuel to the pumping section, from the pumping section to the cylinders, and from the cylinders outwardly of the pump assembly. The assembly is operative to receive and distribute fuel through its pumping section, and the drive mechanism section can be lubricated independently of the pumping section and of the fuel passing therethrough.

Normally, the body of the assembly will comprise a base member supporting the driven means, the latter preferably comprising a rotary cam member for actuating the pistons. The driven means will generally have a shaft that extends through the base member and is adapted for coupling to the engine.

In the preferred embodiments, the pump chamber will comprise a well formed into the "opposite" side surface of the pump block substantially on a central axis thereof, and the piston cylinders will extend on axes parallel to the central axis and will be disposed circumferentially thereabout. The sidewall defining the well will most desirably be eccentric to the central axis of the pump block, with the rotary pump member being comprised of sliding vanes disposed within the well and driven by the shaft, the latter being coaxial with the central axis. The distributor means will normally comprise a head affixed to the pump body against the "opposite" side thereof, and will include a fuel inlet port communicating with the pumping section of the body, and a plurality of fuel outlet ports, each communicating with one of the cylinders.

Preferably, the head will additionally include a fuel bypass valve connected to its inlet port and operatively interposed i between the pumping section and the cylinders of the pump block. The bypass valve will normally permit the fuel from the pumping section to pass to the piston cylinders, but will be responsive to excessive pressure so as to cause at least a portion of the fuel from the pumping section to be diverted to the inlet port of the distributor head. Generally the pump block will additionally include a plurality of reservoirs for receiving fuel from the distributor means, one reservoir being connected to each of the cylinders for feeding fuel thereto.

Most desirably the driven means will comprise a rotary cam member for actuating the pistons, and the assembly will additionally include injection timing means operatively interposed therebetween. Such timing means will be adjustable to effectively alter the angular relationship of the cam member to the pistons. More particularly, the timing means may comprise an angularly adjustable plate, coaxially disposed on the central axis of the pump block to the "one" side thereof, and carrying a plurality of cam followers or lifters corresponding to the number of pistons employed, and aligned therewith. Each lifter will have one end in contact with its associated piston and an opposite end disposed for contact by the cam element of the rotary cam member. The "one" ends of the lifters will be enlarged relative to the corresponding end of the pistons, so as to thereby enable contact therebetween throughout a range of angularly adjusted positions of the plate.

In other preferred embodiments the assembly will additionally include fuel throttle means for adjusting the axial position of the rotary cam member relative to the pistons. Such throttle means will enable alteration of the effective stroke length of the pistons within the cylinders of the pump block, and hence the volume of fuel taken in and injected thereby. More specifically, the throttle means may comprise an axially fixed, angularly adjustable first part, and an axially displaceable, angularly fixed second part, the latter having a portion spaced from the first part and in supporting contact with the rotary cam member of the driven means. The parts of the throttle mean will coact to vary the spacing of the supporting portion of the "second" part upon angular adjustment of the "first" part, to thereby affect piston stroke length, as indicated. Most preferably, the assembly will include a controller for automatically actuating the timing means and/or the throttle means, in response to fuel pressure from the pumping section.

BRIEF DESCRIPTION OF THE DRAWINGS

FIG. 11 is an exploded fragmentary perspective view of the vane sub-assembly drawn to a greatly enlarged scale and showing only one of the blade sets used; and FIG. 12 is a vertical sectional view of a control mechanism suitable for use with the assembly of the invention.

DETAILED DESCRIPTION OF THE ILLUSTRATED EMBODIMENT

Figure 1:
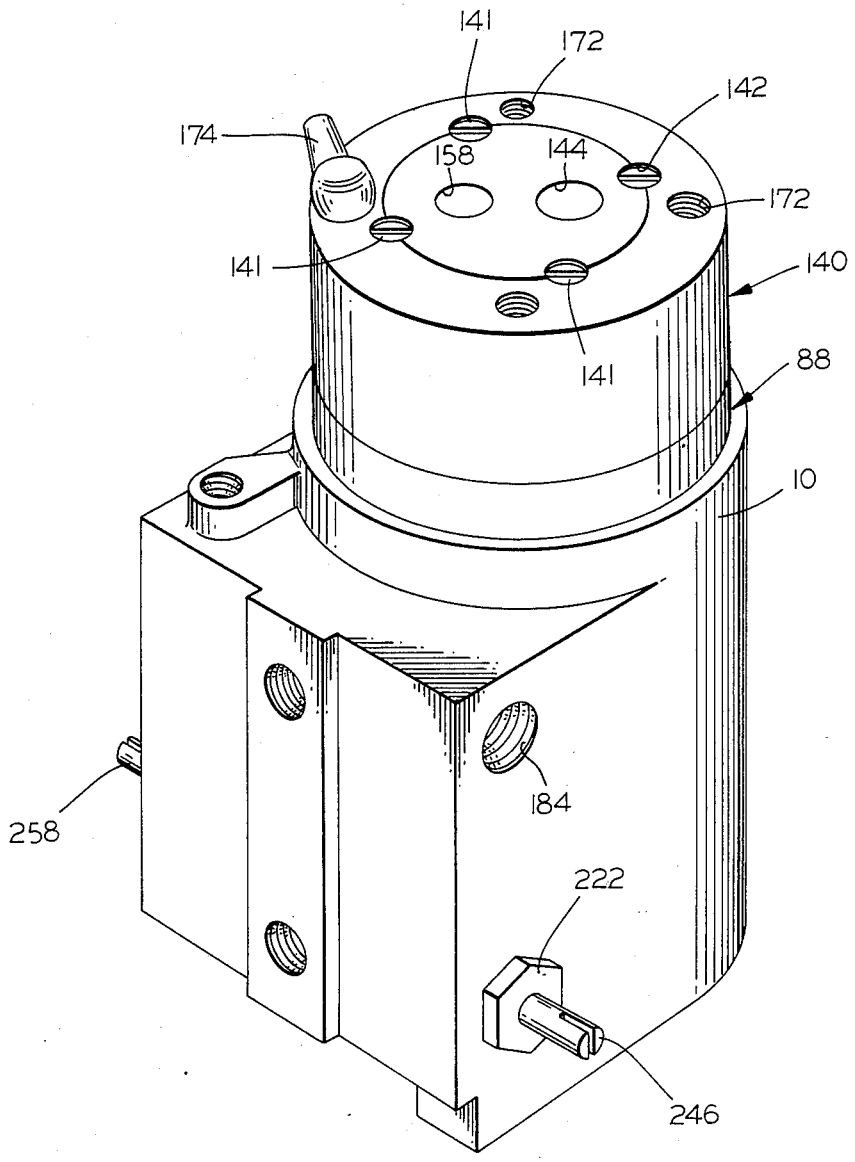
FIG. 1 is a perspective view of a two-stage fuel injection pump assembly embodying the present invention.

Turning now in detail to FIGS. 1–11 of the appended drawings, therein illustrated is a pump assembly embodying the present invention and consisting of a generally cylindrical housing 10 having a lower body member, generally designated by the numeral 12, affixed therewithin. The body member 12 includes a base portion 14 and an upstanding wall portion 16, within which is defined a chamber 18 of generally circular cross-section. An axial bore 20, having an enlarged outer counter-bore section 22, extends through the base 14 of the body member 12, the bore 20 and the counter-bore section 22 receiving, respectively, a sleeve or bushing 24 and a gasket 26. The former is constructed of a low-friction synthetic resinous material (such as Teflon), and the latter is made of any material suitable for sealing the chamber 18 against leakage of lubricant contained therewithin.

A drive shaft, generally designated by the numeral 28, extends through the bushing 24 within the axial bore 20, and is slotted at 30 to engage a suitable coupling of the engine (not illustrated) that is fueled by the pump, and is driven thereby. A collar 32 is affixed to the shaft 28 and is disposed upon the upper surface 34 of the base portion 14 of the body member 12, to maintain the shaft against axial displacement. Also seated upon the surface 34 is a lower elevator plate 33, which has a circular central aperture 35 to receive the collar 32, and four wedge elements 36 disposed at equidistantly spaced circumferential locations thereabout (only two of which are visible in FIG. 2). As will be appreciated, the plate 33 is capable of angular shifting about the shaft 28, and a socket portion 40 projects axially outwardly from the circumference thereof to receive the means (as will be discussed in detail hereinbelow) by which such shifting is effected.

A cooperating upper elevator plate 42 is coaxially mounted above the lower plate 33, and has corresponding wedge elements 44 depending therefrom. The wedge elements 44 have inclined lower surfaces 46 that are complementary to the upper surfaces 38 on the wedge elements 36, and it carries on its upper surface a thrust bearing 47. The plate 42 also has a pair of diametrically projecting ears 48 (best seen in FIG. 3), which are received in axially extending channels 50 formed in the sidewall 16 of the base portion 14. This arrangement constrains the upper plate 42 against rotation while permitting it to move axially; angular shifting of the lower plate 33 will therefore elevate the upper plate 42, due to the camming effect produced.

A rotary cam member, generally designated by the numeral 52, is mounted upon the shaft 28 above the upper cam plate 42 and with its lower surface disposed against the thrust bearing 47. The cam member 52 consists of a circular base portion 54, an upstanding hub portion 56, and a single, wedge-shaped cam element 58. It is affixed to the shaft 88 by a pair of keys 60, which are received in axially extending keyways or channels 62, 64 formed, respectively, into the inner surface of the hub portion 56 and the outer surface of the shaft 28. This locks the rotary cam member 52 onto the shaft 28 for rotation thereby, while permitting its axial displacement therealong.

A lifter sub-assembly, generally designated by the numeral 66, is mounted within the housing 10 upon the upper edge of the sidewall 16 of the body member 12. It consists of a circular holder 68 and four cam followers or lifters, each generally designated by the numeral 70.

The lifters 70 consist of a cylindrical body portion 72, a lower tip having a bottom surface 74, and an enlarged head portion 76, the latter being formed by a circumferential flange, which is flatted along a chord at 78. The holder 68 has four apertures extending therethrough (in FIG. 4, a fifth aperture is shown in phantom line to suggest the structure that the carrier would have in an eight-cylinder pump), each aperture consisting of a cylindrical portion 80 and a flatted, relatively deep annular recess 82 at the juncture of the aperture with the top surface 85 of the holder. As will be appreciated, the carrier assembly 66 includes a lifter 70 seated within each of the apertures 80, with the corresponding flatted surfaces 78, 84, respectively, engaged to maintain a suitable orientation to the bottom surfaces 74 of the lifters 70 with respect to the camming element 58 of the rotary cam member 52, as will be described more fully below. The holder 68 also has a shallow recess 86 extending radially inwardly at a point on its circumference, which recess receives the operating finger of the control mechanism referred to hereinbefore, as will also be described.

The pump block, generally designated by the numeral 88, is fixed within the upper portion of tee housing 10 directly above the carrier sub-assembly 66. It has a well 90 formed into its upper surface 92 in a central location, which communicates with a bore 94 and a counter-bore section 96 extending upwardly from its undersurface 98. The bore 94 and counter-bore section 96 have, respectively, a bushing 100 and a gasket 102 disposed therein, which correspond in composition and function to the bushing and gasket 24, 26, as previously described. The shaft 20 extends through the bore and counter-bore section of the block 88, and has its upper end portion 104 disposed within the chamber 90.

Figure 7:
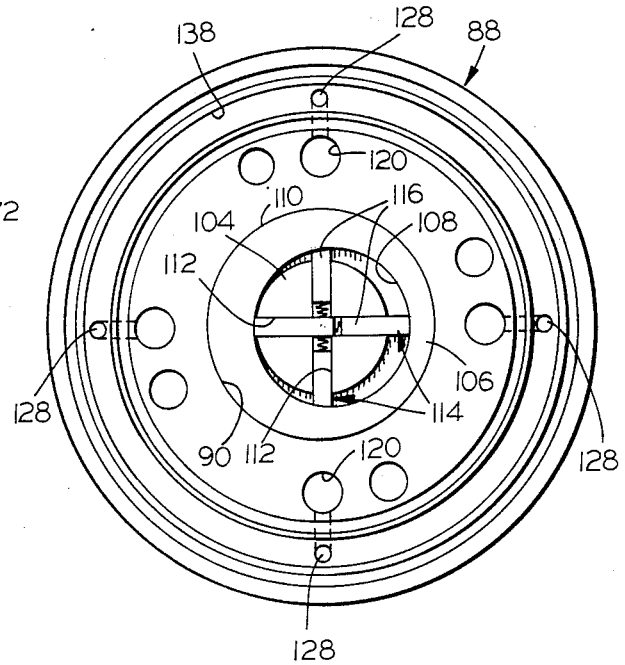
FIG. 7 is a top plan view of the assembly with the distributor head removed to illustrate the rotary pumping section.

An insert 106 of circular exterior cross-section is fixed within the well 90, an provides a circular passageway which defines a pump chamber 108 disposed eccentrically relative to the outside surface 110 thereof (and consequently, relative to the axis of the well 90). As is best seen in FIGS. 7 and 11, the end portion 104 of the shaft 28 has a pair of slots 112 extending at right angles diametrically thereacross, and coupled sets of vane blades, generally designated by the numeral 114, are mounted therewithin. Each set 114 consists of a pair of blades 116, which are attached to one another by small coil spring 118, which exerts an outward bias upon the blades and tends to spread them apart. The one vane set shown in FIG. 11 is oriented for positioning outermost in the end of the shaft 28; it will be appreciated that the other set will have the same construction, but will be inserted in a inverted position, and that the shoulder portions 120 of the blades 116 will permit nesting of sets 114. The biasing force of the coil springs 118 will maintain the blades in contact with the inner surfaces of the insert 106 defining the eccentric chamber 108. Consequently, as the shaft 28 rotates a pumping effect will be created in a manner that is conventional and readily understood by those skilled in the art.

Figure 2:
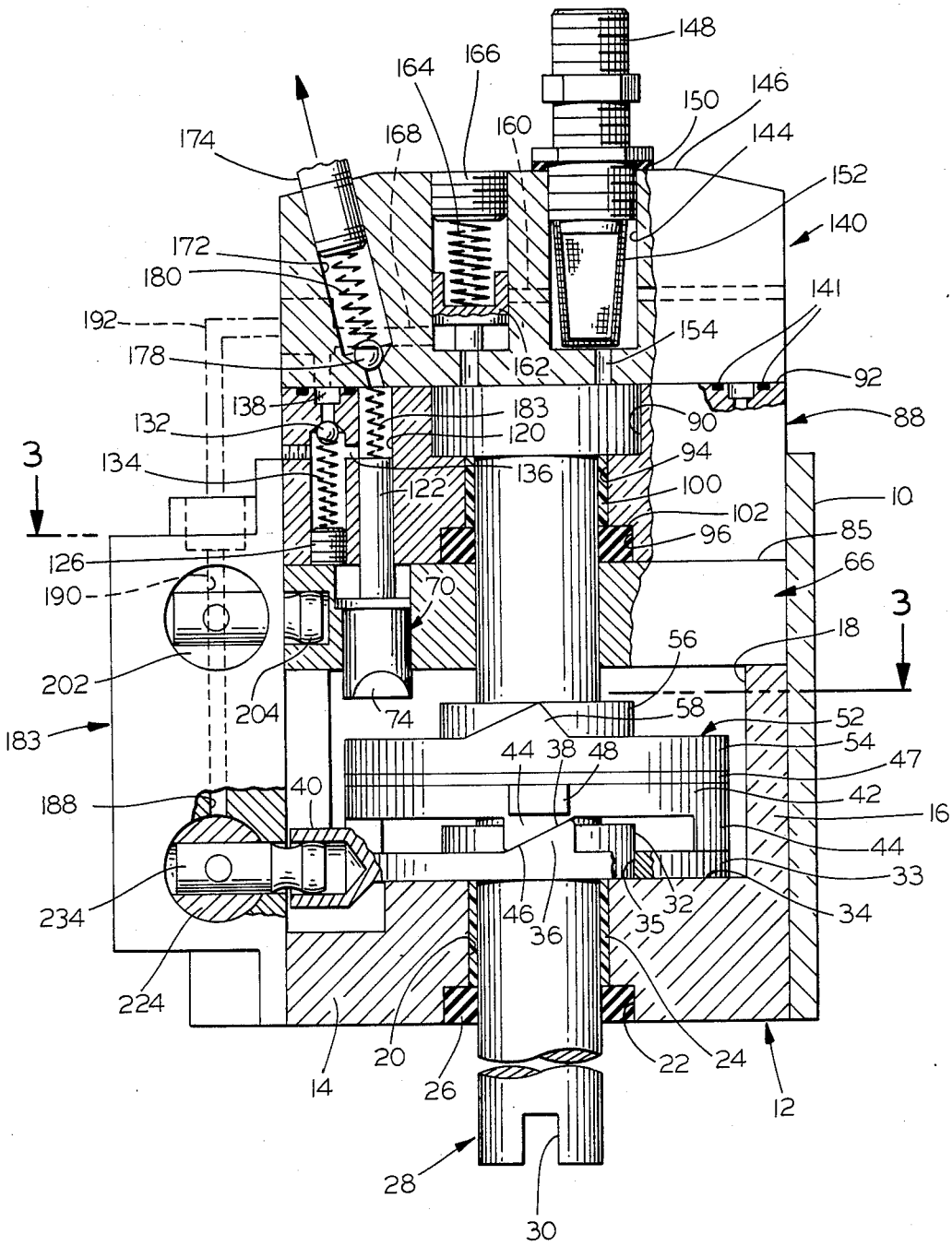
FIG. 2 is a vertical sectional view of the assembly of FIG. 1, drawn to an enlarged scale.
Figure 3:
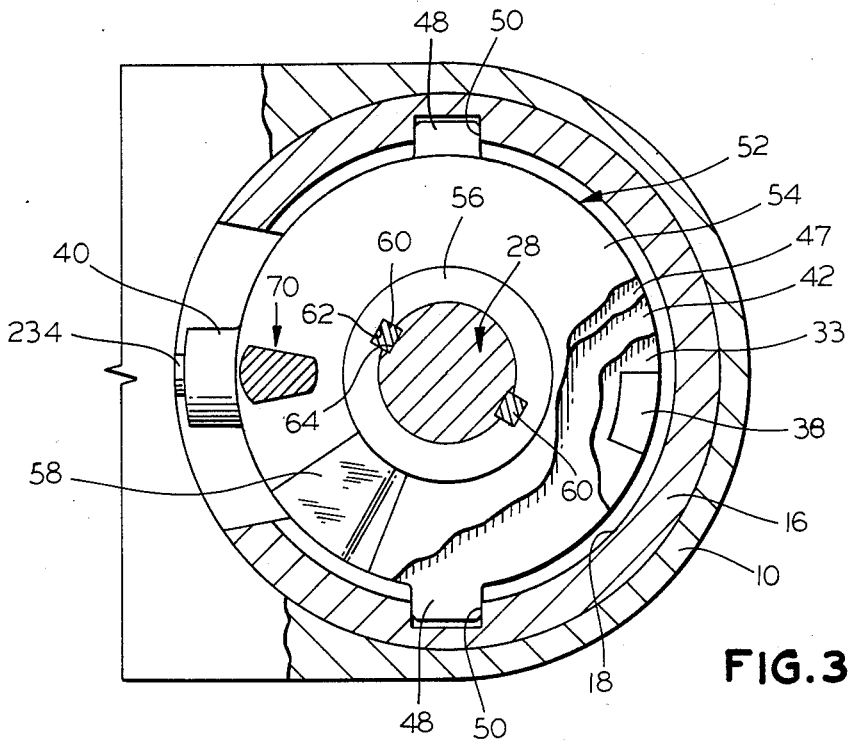
FIG. 3 is a horizontal sectional view of the assembly, taken along line 3—3 of FIG. 2.

The pump block 88 has four cylinders 120 extending therethrough and positioned at equidistantly spaced circumferential locations, and each cylinder 120 has a cylindrical piston 122 slidably mounted therein in close-fitting conformity. As seen in FIG. 2, the lower ends of the pistons 122 contact the upper surface of the head portion 66 of the associated cam follower 70, for actuation thereby in a manner to be described hereinbelow.

Adjacent each cylinder 120 is a bore providing a reservoir 124, which bore extends upwardly from the bottom surface 98 of the pump body 88 and is closed by a set screw 126 threadably engaged therewithin. An inlet port 128 extends downwardly from the top surface 92 into each reservoir 124, and communicates therewith through a conical transition surface 130, which serve as a seat for a ball 132 that is held in position thereagainst by coil spring 134; the bore reservoir 124 communicates with the cylinder 120 through a radially extending port 136. The four inlet ports 128 are interconnected by a circular channel 138 formed into the upper surface 92 of the block 88, which serves to distribute the fuel supplied thereto to all of the reservoirs 124; O-ring gaskets 141 isolate the channel 138 to prevent leakage therefrom.

A distributor head, generally designated by the numeral 140, is disposed upon the pump block 88 and is secured thereto by suitable bolts 141 which are received in apertures 142 through the head 140, and are engaged in threaded openings (not illustrated) in the block 88. A fuel intake well 144 extends downwardly from the top surface 146 of the head 140, and has a coupling 148 threadably engaged within the upper end thereof; a sealing gasket 150 is positioned against mating surfaces, and a filter element 152 is mounted upon the inner end thereof. The fuel well 144 communicates with pump chamber 108 of the pump block 88 through a passageway 154 in the head 140, providing an inlet to that quadrant of the rotary pump section at which the eccentric relationships cause the vane blades 116 to define an enlarged volume. A second such passageway 156 through the head 140 constitutes a outlet from a diminished volume quadrant of the pumping section, and is in communication with a relief valve chamber 158. The latter communicates with the inlet well 144 through a laterally extending passageway 160, which is normally closed by the cup-shaped valve element 162 slidably mounted therewithin. The element 162 is biased downwardly by the coil spring 164, the opposite end of which bears against the plug 166 that is threadably engaged within the upper end of the chamber 158.

As will be apparent, fuel supplied to the well 144, through the coupling 148, will normally pass through the passageway 154 into the chamber 108 of the rotary pumping section, from which it will be discharged under pressure through the outlet passageway 156 and into the valve chamber 158. Pressure in the fuel supply will lift the valve element 162 against the force of the coil spring 164, permitting a portion of the fuel to flow through the lateral passage 160 and back into the inlet chamber 144 if the pressure becomes great enough, thus affording relief against excessively high pressures developed by the rotary pump. A second lateral passage 168 extends from the valve chamber 158 and communicates with the downwardly extending passage 170, which in turn connects to the circumferential channel 138 of the pump block 88. Consequently, it will be appreciated that the normal flow of fuel from the valve chamber 158 is through the passage 168, 170, for delivery to the reservoirs 124 and the piston chambers 120.

Also provided within the distributor head 140 are four injection ports 172, to which are attached connecting nipples 174, one of which is shown in detail in FIG. 1. The injection port 172 has a conical seat portion 176 adjacent its lower end, against which the ball 178 will seat under the influence of the coil spring 180, in the absence of opposing force; the coil spring bears against the inner end of the associated connecting nipple 174. A short aperture 182 connects the injection port 172 to the associated cylinder 120, the head 140 being positioned on the block 88 so as to establish such alignment.

Operation of the pump assembly, to the extent thus far described, can be understood by reference to the drawings. Rotation of the shaft 28 causes the vane sets 114 to rotate within the pump chamber 108, drawing fuel from the well 144 and supplying it to the reservoirs 124, from which it flows into the cylinders 120. When the pistons 122 are then actuated by the lifters 70, the fuel contained within each cylinder 120 will displace the ball 178 of the corresponding port 172, from which it will be injected thereafter through the connecting nipple 174. Although not shown, it will be appreciated that the nipples 174 are, in turn, connected by suitable means to the cylinders of the engine that is fueled by the pump assembly. It will also be appreciated that the spring-loaded ball 132, contained within each of the reservoirs 124, serves to prevent back-flow of fuel from the associated cylinder 120 when the piston 122 is driven in its injection stroke.

The wedge-shaped cam element 58 on the rotary cam member 52, which is also driven by the shaft 28, effects the necessary upward movements of the pistons 122, against the downward force of the coil springs 183, by sequentially contacting the bottom surface 74 on the tip portions of the associated lifters 70. The lifters are so disposed that the edges of the bottom surfaces 74 thereof are maintained in a position transverse to the inclined surface of the element 58. In the position shown in FIG. 2, the cam member 52 is positioned just below the plane in which the lowermost edges of the lifters 70 are disposed, and consequently no injection of fuel from the cylinders 120 would be effected during rotation. The cam element 58 is brought into effect by elevating the rotary cam 52; this is done by angularly shifting the lower cam plate 36, to thereby elevate the upper plate 42 and, in turn, the member 52. The angle of shift (typically, the total range will be about 12°) will determine the volume of fuel that is ejected from the cylinders 122. Obviously, the higher the member 52 is positioned the longer will be the stroke of the pistons and consequently the greater will be the volume of fuel discharged; the highest elevation will, of course, produce the maximum operating speed.

Figure 4:
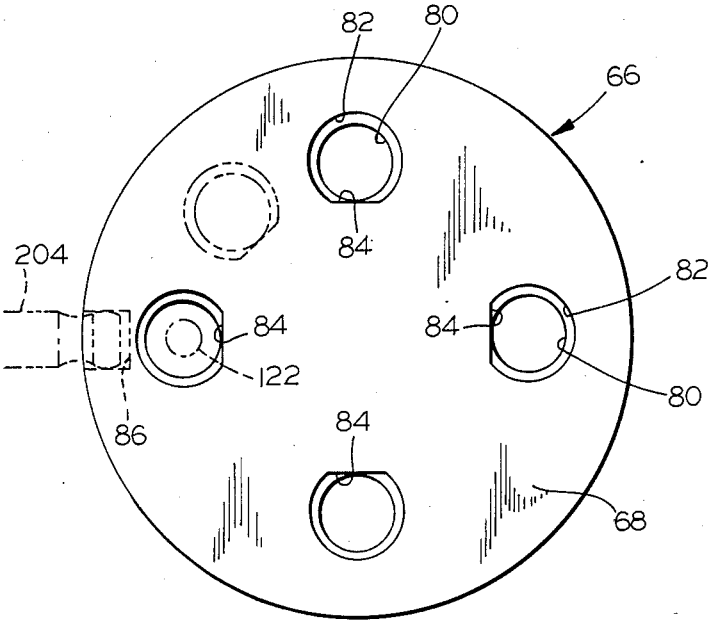
FIG. 4 is a plan view of the lifter and holder subassembly utilized in the pump, showing in phantom line the associated operating finger of the control mechanism and the position of one of the pistons over its associated lifter, and suggesting the location of an additional lifter for an eight-cylinder pump.
Figure 5:
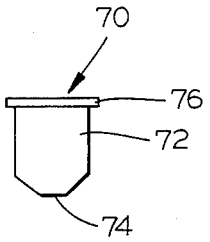
FIG. 5 is an elevational view of one of the lifters utilized in the pump.
Figure 6:
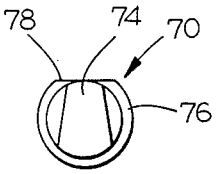
FIG. 6 is a bottom view of the lifter.
Figure 9:
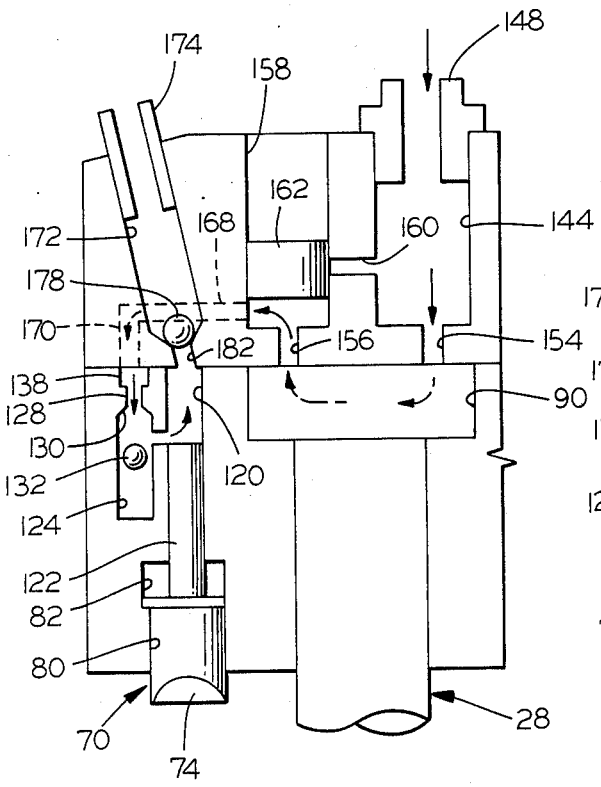
FIG. 9 is a diagramatical view showing the flow of fuel through the assembly during the normal fuel intake phase of operation.
Figure 10:
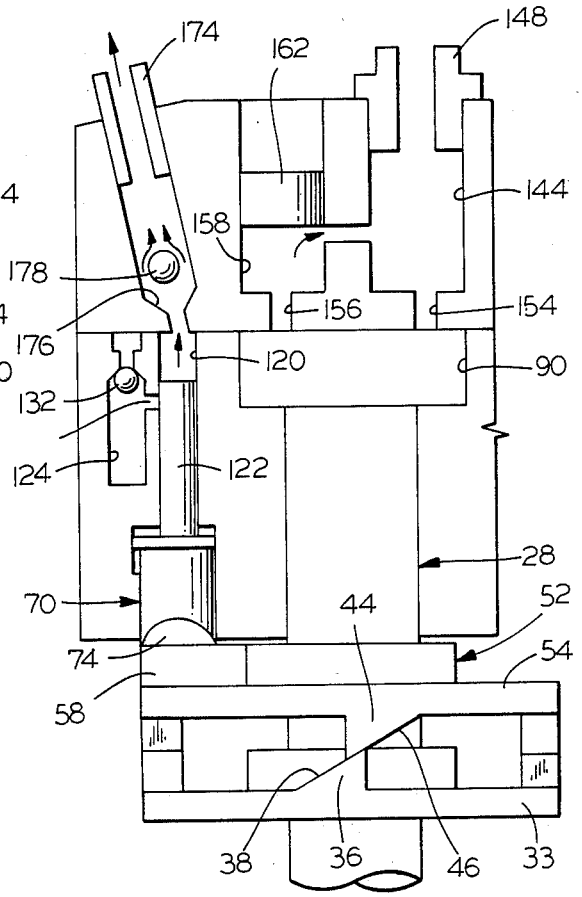
FIG. 10 is a view similar to FIG. 9 showing the injection phase, and also illustrating recycle of a portion of the fuel through the relief valve.
Figure 8:
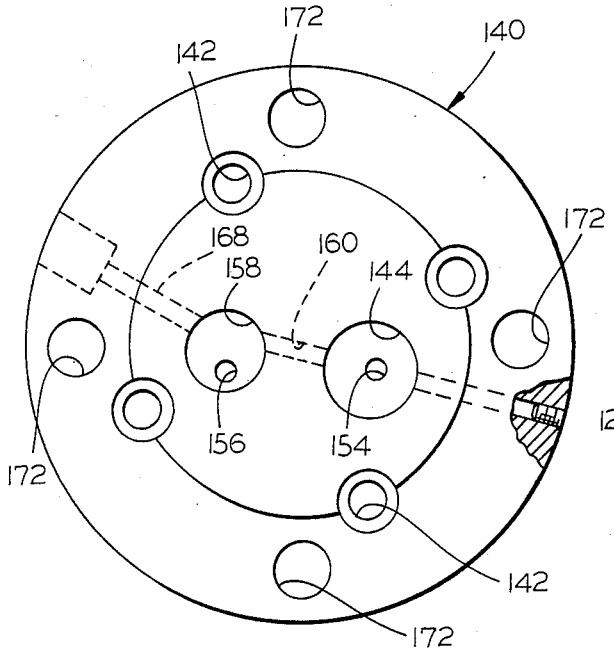
FIG. 8 is a top plan view of the assembly, illustrating the distributor head.

As has also been mentioned previously, shifting of the holder 68 of the carrier sub-assembly 66 affects timing. In FIG. 4, the holder 68 is so positioned that the head portions 76 of the lifters 70 are disposed substantially co-axially with the associated piston 122 (one of which is shown so aligned in phantom line). Turning the holder 68 in clockwise direction will cause the lifters to shift, relative to the respective pistons 122, in such a manner that they will be operated at an earlier point in the cycle of the engine, and timing will be advanced. Conversely, turning the holder in a counterclockwise direction will change the relative positions of the lifters and pistons so as to retard the timing of fuel injection.

Turning now to FIG. 12, therein illustrated is a hydraulic control unit utilized to automatically effect speed and timing adjustments. The unit consists of a body, generally designated by the numeral 182, which has first and second cylindrical chambers 184 and 186, respectively, formed laterally through it. The chambers are interconnected by a flow passage 188, and are supplied through an inlet 190, which opens into the chamber 184. As will be appreciated, pressurized fuel from the rotary pumping section of the pump assembly is supplied to the control device through a connecting tube 192, shown in phantom line in FIG. 2.

One end of the chamber 184 is closed by a plug 194, which is threadably engaged therewithin and through which an adjustment screw 196 extends. The opposite end has a similar plug 198 mounted therewithin, through which also extends an adjustment screw 200. A cylinder 202 is slidably mounted within the chamber 184, and it has an operating finger 204 affixed therewithin by a set screw 206 and extending laterally therefrom. One end of the cylinder has a groove 208 formed circumferentially thereabout, in which is seated an O-ring sealing element 210. The cylinder 202 is biased in one direction by a coil spring 212, which bears thereagainst and against the face of the plug 194. The opposite end of the cylinder has an axial recess 214 formed therein, in which is mounted a second coil spring 216, the other end of which is received within a similar recess 218 formed into the face of the plug 198.

The operating finger 204 of the cylinder 202 is received within the recess 86 of the holder 68 of the lifter sub-assembly 66; this is best seen in FIG. 2. Consequently, shifting of the cylinder 202 within the chamber 186 will turn the holder 68, and thereby change the timing of the pump assembly, in the manner previously described. As will be evident, an increase in pressure in the liquid flowing through line 192 will cause the cylinder 202 to shift to the right (as seen in FIG. 12), a reduction in pressure will, of course, cause reverse movement.

The two springs 212, 216 will generally be selected to balance the cylinder 202 and to maintain it in a centralized position. Screw 196 may be adjusted to shift the cylinder 202 to the right, and screw 200 is used as a stop member, limiting the travel of the cylinder in the opposite direction. Thus, the screws 196, 200 may be used to superimpose mechanical constraints upon the normal hydraulic operation of the control unit.

The second chamber 186 also contains end plugs 220, 222, a cylinder 224 having an O-ring 226 seated within its circumferential groove 228, and a pair of coil springs 230, 232, all similarly disposed; the cylinder 224 also carries an operating finger 234, held in place by a set screw 236. The operating finger 234 is engaged within the socket portion 40 of the lower plate 33 of the cam elevating mechanism (see FIG. 2), to effect its angular shift and thereby to control speed, as hereinabove described.

Secured to the body 182 are a pair of brackets 238, each of which pivotably mounts one end of a control lever 240, 242, which levers are, in turn, engaged by suitable operating linkages (not shown). The lever 240 is slotted at 244 to engage the pin of an adjusting rod 246, which passes through an aperture 248 in the plug 222. A sealing O-ring 250 is disposed within a circumferential groove formed into the surface of the rod 246, and a collar 252 is mounted upon the threaded inner end 254 thereof; the coil spring 232 bears against the collar 252, the position of which can be changed to adjust the level of force exerted. Pivoting the lever 240 in a clockwise direction will increase the force on the cylinder 224, thereby urging it to the left in the drawing; the bolt 256 prevents movement of the lever 240 in the opposite direction. The lever 244 similarly operates the rod 258 that is received in the aperture 260 of the other plug 220. Movement in a clockwise direction will move the rod 258 further into the chamber 186, ultimately to bear upon the adjacent end of the cylinder 224. Thus, the levers 240, 242 are used to accelerate, and decelerate and stop, the engine.

The position of the cylinder 224 within tee chamber 186 is also controlled by pressure from the pumping section, transmitted thereto through the passageway 188. An increase in pressure will urge the cylinder 224 to the right, whereas pressure reduction will cause it to shift to the left from the position shown. In this manner the volume of fuel injected will automatically change in response to the pressures developed in the fuel line, resistance of the spring 232, however, being sufficiently great to restrain movement of the cylinder below a selected pressure, thus functioning as a governor.

Thus, it can be seen that the present invention provides a novel pump assembly in which the pumping section is segregated from the drive mechanism, thereby permitting independent lubrication of the latter, and use of the pump for a relatively non-lubricating fuel. More specifically, the invention provides a two-stage injection pump that is adapted for use with aqueous fuels for hydrogen powered systems, which pump is also relatively uncomplicated and is highly efficient and dependable in use. The assembly may, in addition, have novel means for readily permitting adjustment of its timing to the ignition cycle of the engine with which it is employed, and it may have novel throttling means for permitting automatic adjustment of the volume of fuel injected.

Having thus described the invention, what is claimed is:

1. A two-stage fuel injection pump assembly comprising:

a. a body;

b. a pump block mounted within said body and defining to one side thereof a drive mechanism section therewithin, said block having a pump chamber disposed to the opposite side thereof, and a plurality of piston cylinders extending therethrough and disposed thereabout on axes that are generally parallel to a central axis of said block;

c. a corresponding plurality of injection pistons slidably mounted for reciprocal movement within said cylinders;

d. sealing means for segregating said pump chamber and said drive mechanism section against the passage of liquid therebetween;

e. a rotary pump member seated within said pump chamber of said block and providing therewith a pumping section;

f. driven means within said drive mechanism section operatively connected for reciprocation of said pistons and rotation of said pump member;

g. distributor means disposed to said opposite side of said pump block and adapted to cooperate therewith to distribute fuel to said pumping section, from said pumping section to said cylinders, and from said cylinders outwardly of said pump assembly, whereby said assembly is operable to receive and distribute fuel through said pumping section, and said drive mechanism section thereof can be lubricated independently of said pumping section and of the fuel passing therethrough.

2. The assembly of claim 1 wherein said body comprises a base member supporting said driven means, and wherein said driven means comprises a rotary cam member for actuating said pistons in properly timed sequence.

3. The assembly of claim 2 wherein said driven means includes a shaft which extends through said base member and is adapted for coupling to the prime mover fueled thereby.

4. The assembly of claim 1 wherein said pump chamber comprises a well, formed into said opposite side surface of said pump block and substantially on said central axis thereof, and wherein said piston cylinders are disposed circumferentially thereabout.

5. The assembly of claim 4 wherein the sidewall defining said well is eccentric to said central axis, and said rotary pump member is comprised of sliding vanes disposed within said well and driven by said shaft, said shaft being coaxial with said central axis of said pump block.

6. The assembly of claim 1 wherein said pump block additionally includes a plurality of reservoirs for receiving fuel from said distributor means, one of said reservoirs being connected to each of said cyliners for feeding fuel thereto.

7. The assembly of claim 1 wherein said distributor means comprises a head affixed to said pump body against said opposite side thereof, said head including a fuel inlet port communicating with said pumping section of said body, and a plurality of fuel outlet ports each communicating with one of said cylinders thereof.

8. The assembly of claim 7 wherein said head additionally includes a fuel bypass valve connected to said inlet port thereof and operatively interposed between said pumping section and said cylinders of said pump block, said bypass valve normally permitting the fuel from said pumping section to pass to said piston cylinders and being responsive to excessive pressure to cause at least a portion of the fuel from said pumping section to be diverted to said inlet port.

9. The assembly of claim 1 additionally including injection timing means operatively interposed between said driven means and said pistons, said driven means comprising a rotary cam member for periodically lifting said pistons, and said timing means being adjustable to alter the angle of rotation at which said cam member is effective to operate said pistons.

10. The assembly of claim 9 wherein said timing means comprises an angularly adjustable plate coaxially disposed on said central axis to said one side of said pump body, and a plurality of lifters corresponding to said pistons and carried by said plate, one of said lifters being aligned with each of said pistons and having one end in contact therewith and the opposite end disposed for contact by the cam elements of said rotary cam member, said one end of said lifters being enlarged relative to the corresponding end of said pistons to enable contact therebetween throughout a range of angularly adjusted positions of said plate.

11. The assembly of claim 1 additionally including fuel throttle means for adjusting the axial position of said rotary cam member relative to said pistons, said throttle means enabling alteration of the effective stroke length of said pistons within said cylinders of said pump block, and hence the volume of fuel injected thereby.

12. The assembly of claim 11 wherein said throttle means comprises an axially fixed, angularly adjustable first part, and an axially displaceable, angularly fixed second part having a portion spaced from said first part and in supporting contact with said rotary cam member, said parts of said throttle means coacting to vary the spacing between said first part and said supporting portion of said second part upon angular adjustment of said first part.

13. The assembly of claim 10 additionally including a controller for automatically actuating said timing means in response to fuel pressure from said pumping section.

14. In a fuel injection pump assembly including a body, a pump block mounted within said body and having a plurality of piston cylinders extending therethrough, a corresponding plurality of injection pistons slidably mounted for reciprocal movement within said cylinders, and driven means operatively connected for reciprocation of said pistons and comprising a rotary cam member having at least one cam element for periodically lifting said pistons, the improvement comprising: injection timing means operatively interposed between said driven means and said pistons, said timing means comprising an angularly adjustable plate disposed to one side of said pump body, and a plurality of lifters corresponding to said pistons and carried by said plate, one of said lifters being aligned with each of said pistons and having one end in contact therewith and the opposite end disposed for contact by said cam element of said rotary cam member, said one end of said lifters being enlarged relative to the corresponding end of said pistons to enable contact therebetween throughout a range of angularly adjusted positions of said plate, said timing means being adjustable to alter the effective angle of rotation at which said cam member is effective to operate said pistons, whereby the timing of fuel injection can be adjusted in accordance with the speed of a prime motor fueled by said pump assembly and driving said driven means thereof.

15. The assembly of claim 14 wherein said assembly comprises a two-stage pump having a pumping section for receiving fuel and supplying it to said pistons for injection thereby, and wherein said assembly additionally includes a controller for automatically actuating said timing means in response to the level of fuel pressure in said pumping section.

16. The assembly of claim 12 additionally including a controller for automatically actuating said throttle means in response to fuel pressure from said pumping section.

* * * * *